US009889537B2

(12) United States Patent
Ji

(10) Patent No.: US 9,889,537 B2
(45) Date of Patent: Feb. 13, 2018

(54) SEAMLESS FLOWING TYPE FINISHING MACHINE

(71) Applicant: ZHEJIANG HUMO POLISHING GRINDER MANUFACTURE CO., LTD., Huzhou, Zhejiang (CN)

(72) Inventor: Xinglin Ji, Zhejiang (CN)

(73) Assignee: ZHEJIANG HUMO POLISHING GRINDER MANUFACTURE CO., LTD., Huzhou (CN)

( * ) Notice: Subject to any disclaimer, the term of this patent is extended or adjusted under 35 U.S.C. 154(b) by 83 days.

(21) Appl. No.: 15/039,061

(22) PCT Filed: May 29, 2015

(86) PCT No.: PCT/CN2015/080242

§ 371 (c)(1),
(2) Date: May 25, 2016

(87) PCT Pub. No.: WO2016/169101

PCT Pub. Date: Oct. 27, 2016

(65) Prior Publication Data

US 2017/0080544 A1 Mar. 23, 2017

(30) Foreign Application Priority Data

Apr. 23, 2015 (CN) ..... 2015 2 0253096 U

(51) Int. Cl.
*B24B 31/108* (2006.01)
*B24B 31/02* (2006.01)

(52) U.S. Cl.
CPC ..... *B24B 31/02* (2013.01); *B24B 31/108* (2013.01)

(58) Field of Classification Search
USPC ..... 451/327, 328, 326, 32, 113, 104
See application file for complete search history.

(56) References Cited

U.S. PATENT DOCUMENTS 5,823,861 A * 10/1998 Kobayashi ..... B24B 31/108 451/104
6,296,556 B1 * 10/2001 Gegenheimer ..... B24B 31/108 451/326
6,379,233 B1 * 4/2002 Kobayashi ..... B24B 31/108 451/326
6,656,027 B2 * 12/2003 Dietrich ..... B24B 31/108 451/326
6,682,401 B2 * 1/2004 Kobayashi ..... B24B 31/108 451/28

(Continued)

*Primary Examiner* — Robert Rose

(57) ABSTRACT

The invention discloses a seamless flowing type finishing machine, comprising a supporting frame; the supporting frame is provided with a lower container, an upper container and a tray; the tray is movably connected with the lower container. A plurality of bolts is arranged between the lower container and the upper container for connection; springs are arranged at the connections of the bolts. The upper edge of the tray extends to the lower edge of the upper container; with the elastic force of the springs, the lower edge of the upper container clings to the upper edge of the tray so as to form a seamless connecting structure; a water outlet is arranged on the tray. A water-filling nozzle is arranged on the sidewall of the lower container. The seamless flowing type finishing machine disclosed by the invention can be used for processing of various ultra-small parts.

9 Claims, 2 Drawing Sheets

(56) References Cited

U.S. PATENT DOCUMENTS 8,801,498 B2 * 8/2014 Hammond ..... B24B 31/108
451/104
9,463,549 B2 * 10/2016 Schmidt ..... B24B 31/02

* cited by examiner

SEAMLESS FLOWING TYPE FINISHING MACHINE

TECHNICAL FIELD

The invention relates to a flowing type finishing machine, especially a seamless flowing type finishing machine capable of processing various kinds of workpieces.

DESCRIPTION OF THE RELATED ART

The present flowing type finishing machine is widely applied in different industries and is capable of removing oxidation films and blurs. However, the upper container and the lower container of the conventional flowing type finishing machine are a fixedly connected structure, so that a gap between the tray in the lower container and a working container of the upper container is kept to be about 0.5 mm; if the gap is less than 0.5 mm, workpieces cannot be finished and processed.

BRIEF SUMMARY OF THIS INVENTION

The gap between the containers of the present finishing machine is difficult to be precisely adjusted, is easily stuck when the size of the gap is less than 0.5 mm, and workpieces cannot be processed; in order to solve the problems, the invention provides an improved seamless flowing type finishing machine.

For achieving the above purposes, the following technical schemes are adopted in the invention:

The seamless flowing type finishing machine provided by the invention comprises a supporting frame; the supporting frame is provided with a lower container, an upper container and a tray; the tray is movably connected with the lower container, and the bottom thereof the tray is connected with a rotatable spindle; the upper container and the lower container are partitioned into two chambers by the tray; the two chambers are respectively used as a working chamber at the upper part of the tray and a water storage chamber at the lower part of the tray; a plurality of bolts are arranged between the lower container and the upper container for connection; springs are arranged at the connections of the bolts; the upper edge of the tray extends to the lower edge of the upper container with the elastic force of the springs, the lower edge of the upper container clings to the upper edge of the tray to form a seamless connecting structure; a water outlet is arranged on the tray; the spindle is connected with a drive motor through a transmission mechanism; and a water-filling nozzle is arranged on the sidewall of the lower container.

The invention has the following outstanding effects:

1. The lower container and the upper container are connected by the bolts with the springs; the expansion force of the springs is adopted, so that the lower edge of the internal wall of the upper container is in seamless contact with the upper edge inside the tray. When the water storage chamber is full of water, the hydraulic pressure counteracts the elastic force, so that the upper container floats upward within a small range. Therefore, a small gap is formed and is about 0.01 mm in size; the seamless flowing type finishing machine is capable of processing small workpieces and can be applied to the chamfering, blur-removal, finishing and other technical processing of various ultra-small parts.
2. The gap between the upper container and the lower container in the prior art is difficult to adjust and the bolts cannot be used at the same time. Moreover, the gap is very small and cannot be precisely adjusted; the seamless flowing type finishing machine is automatically regulated by using the elastic force and the hydraulic pressure and is simple and convenient.

Preferably, the water-filling nozzle is arranged at the centre of the bottom of the tray; the water outlet vertically passes through the centre of the spindle until the bottom of the lower container. The centre of the tray is used as the lowest position, so that water can be discharged conveniently and completely. Moreover, the water outlet is arranged at the rotating centre and is difficult to leak water during rotation, so that water at the lateral sides is squeezed out because of centrifugal force.

Preferably, the filter cap is arranged at the water intake part of the water nozzle to prevent the water nozzle from being blocked by chippings after grinding.

Preferably, a ceramic ring is arranged on the lower container close to the lower edge and is a vulnerable part for protecting the upper container.

Preferably, the transmission mechanism is a synchronous belt transmission mechanism.

Preferably, the number of the bolts for connecting the lower container and the upper container is six and the bolts are annularly and uniformly distributed.

Preferably, inclined saw-tooth patterns are formed on the internal sidewall of the upper container. During rotation, the tray produces an eddy-current type movement to form a long frictional track; the inclined saw-tooth patterns are formed on the internal sidewall of the upper container to strengthen the grinding effect.

Preferably, the water-filling nozzle is connected with a storage container for storing mixture of water and grinding fluid; a metering pump used as a water intake power unit is arranged beside the storage container.

Preferably, the finishing machine is provided with a control device for controlling the rotating speed of the tray; the control device comprises an electric cabinet and a touch screen.

The seamless flowing type finishing machine has the following useful effects: the finishing machine can be applied to the chamfering, blur-removal, finishing and other technical processing of various kinds of ultra-small parts; the water filling gap is automatically regulated and is simple and convenient.

Figure 1:
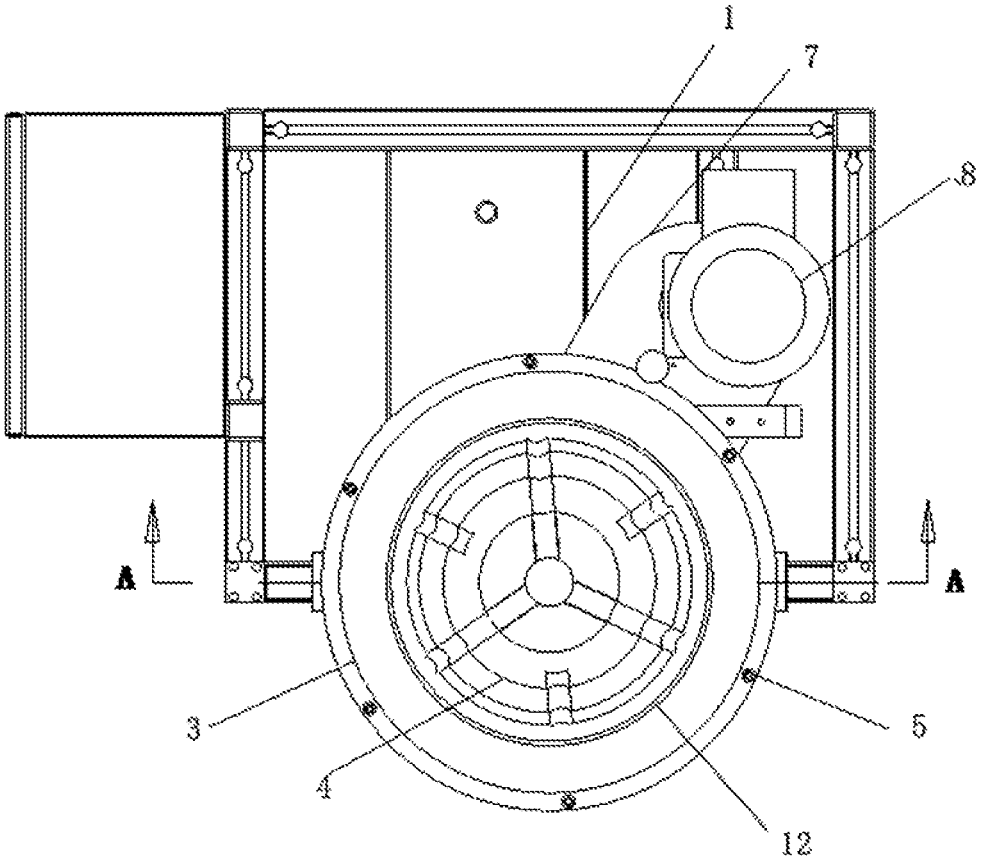
FIG. 1 is the schematic view of the invention.

In the drawings: 1—supporting frame, 2—lower container, 3—upper container, 4—tray, 5—bolts, 6—spindle, 7—transmission mechanism, 8—drive motor, 9—water outlet, 10—filter cap, 11—ceramic ring.

DESCRIPTION OF THE SPECIFIC EMBODIMENTS

The invention is further described in combination with the following drawings and the specific implementing modes.

Figure 2:
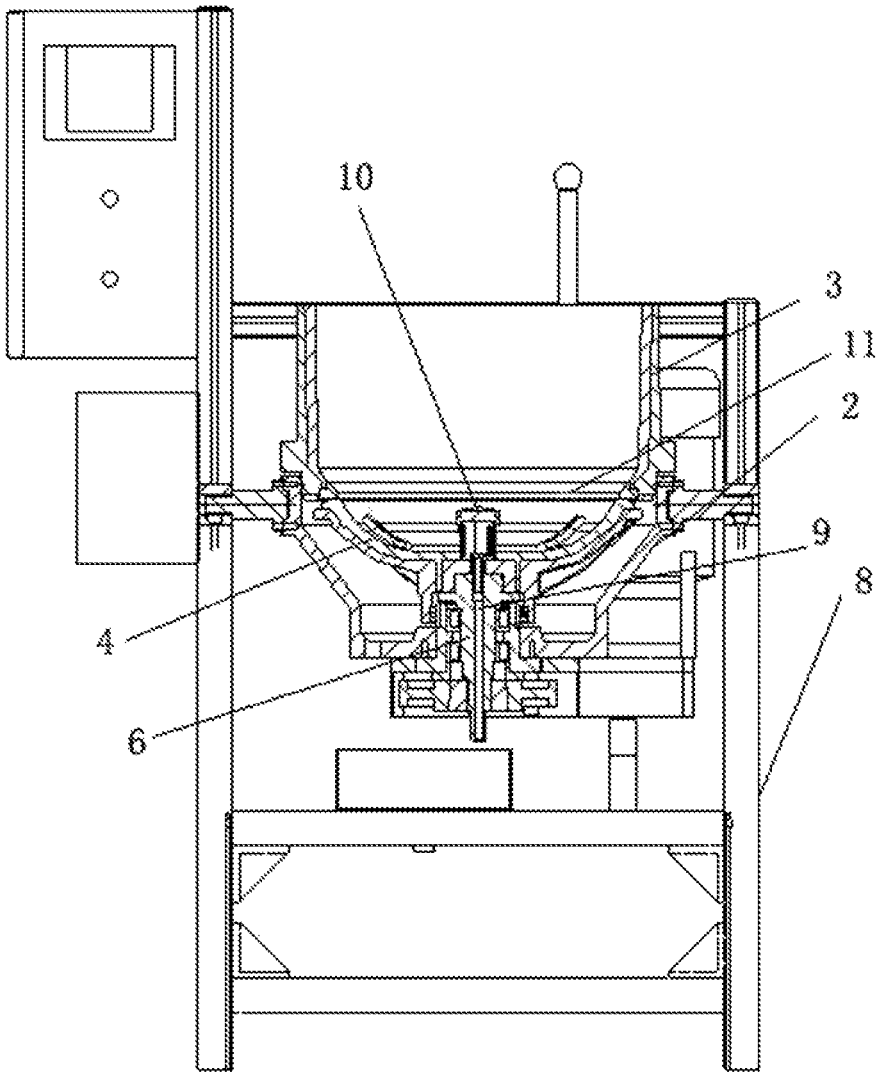
FIG. 2 is the A-A sectional view of FIG. 1.

In the embodiments shown in FIG. 1 and FIG. 2, the working volume of the seamless flowing type finishing machine is 50L. The seamless flowing type finishing machine comprises a supporting frame 1; the supporting frame 1 is provided with the lower container 2, the upper container 3 and the tray 4. The tray 4 is movably connected to the lower container 2; the bottom of the tray 4 is connected with the rotatable spindle 6; the spindle 6 is connected with the drive motor 8 through the transmission mechanism 7. The transmission mechanism 7 is a synchronous belt transmission mechanism. The upper container 3 and the lower container 2 are partitioned into two chambers by the tray 4; the chambers are respectively used as the working chamber at the upper part of the tray 4 and the water storage chamber at the lower part of the tray 4. Inclined saw-tooth patterns are formed on the internal sidewall of the upper container 3.

Six bolts 5 are arranged between the lower container 2 and the upper container 3 for connection and are annularly and uniformly distributed. Springs are arranged at the connections of the bolts 5; two ends of each spring are respectively connected with the upper container and the lower container. Or the bolts and the springs form gas spring connecting rods; the upper container and the lower container are connected by the gas spring connecting rods.

The upper edge of the tray 4 extends to the lower edge of the upper container 3; with the elastic force of the springs, the lower edge of the upper container 3 clings to the upper edge of the tray 4 to form a seamless connecting structure.

The water outlet 9 is arranged on the tray 4 and arranged at the centre of the bottom of the tray 4; the water outlet 9 vertically passes through the centre of the spindle until the bottom of the lower container 2. The filter cap 10 is arranged at the water intake part of the water outlet 9; and the water-filling nozzle is formed on the side wall of the lower container 2.

The ceramic ring 11 is arranged at the upper container 3 close to the lower edge. The water-filling nozzle is connected with a storage container for storing mixture of water and grinding fluid; a metering pump used as a water intake power unit is arranged beside the storage container. The metering pump is controlled by a pressure-operated switch inside the storage container, is used for confirming that the pressure-operated switch is located in the storage container, and is 20 mm away from the bottom. If the pressure-operated switch is located at the bottom of the mixed fluid storage container and even if the mixed fluid storage container is empty, the machine does not stop working.

The finishing machine is provided with a control device for controlling the rotating speed of the tray; the control device comprises an electric cabinet and a touch screen. A power supply switch and an emergency stop button are arranged on the side of the touch screen. The drive motor has two operating modes, including a constant-speed mode and a variable-speed mode. In the constant-speed mode, the motor is operated at a high operating speed; in the variable-speed mode, the motor is operated alternatively at a high speed and at a low speed.

The less the mixed fluid of water and grinding fluid in the working chamber is, the more the grinding force is. The highest grinding force is produced when the speed is reduced to be the minimum. Under the variable-speed mode, if the high-speed operating time is set to be 10 min and the low-speed operating time is set to be 1 min, the working chamber will be cyclically operated at intervals. Wastewater is discharged via the water outlet at the centre of the tray during the low-speed time. Under the constant-speed mode, the grinding force is reduced to be the minimum. Under the constant-speed mode, the working chamber does not slow down at the set intervals, and wastewater is always left in the working chamber.

The using procedures are as follows:

1. Put the pressure-operated switch of the metering pump into the storage container of grinding fluid and water.
2. Check and confirm whether the valve is closed.
3. Start the water pump in the manual mode of the touch screen. At this moment, the tray is not rotated, but the lower container is being filled with the mixed fluid of water and grinding fluid. The operation is necessary; or else, the finishing machine will be damaged because of "dry rotation".
4. Adjust the flow of the mixed fluid of water and grinding fluid to be the maximum.
5. Keep the setting until the mixed fluid flows to the working container.
6. Switch the manual mode into the automatic mode and choose the variable-speed mode.

After the above procedures, the working container has been set properly and can be used for the first processing.

7. Add grinding materials to the working container.
8. Set the processing time.
9. Set the rotating speed.
10. Press the system start key and start the system.
11. Adjust the concentration of the mixed fluid (manual operation).
12. Adjust the flow rate of the mixed fluid.
13. Adding to-be-finished parts.

During the whole processing, the grinding force can be controlled by adjusting the flow rate of the mixed fluid flowing to the grinding materials.

What is claimed is:

1. A seamless flowing type finishing machine comprising a supporting frame (1); the supporting frame (1) is provided with a lower container (2), an upper container (3) and a tray (4); the tray (4) is movably connected with the lower container (2), and the bottom of the tray (4) is connected with a rotatable spindle (6), characterized in that: the upper container (3) and the lower container (2) are partitioned into two chambers by the tray (4); the two chambers are respectively used as a working chamber at the upper part of the tray (4) and a water storage chamber at the lower part of the tray (4); a plurality of bolts (5) are arranged between the lower container (2) and the upper container (3) for connection; springs are arranged at the connections of the bolts (5); the upper edge of the tray (4) extends to the lower edge of the upper container (3); with the elastic force of the springs, the lower edge of the upper container (3) clings to the upper edge of the tray to form a seamless connecting structure; a water outlet (9) is arranged on the tray (4); the spindle (6) is connected with a drive motor (8) through a transmission mechanism (7); and a water-filling nozzle is arranged on the sidewall of the lower container (2).

2. The seamless flowing type finishing machine according to claim 1, wherein the water outlet (9) is arranged at the centre of the bottom of the tray (4) and vertically passes through the centre of the spindle till the bottom of the lower container (2).

3. The seamless flowing type finishing machine according to claim 2, wherein a filter cap (10) is arranged at the water inflowing part of the water outlet (9).

4. The seamless flowing type finishing machine according to claim 1, wherein a ceramic ring (11) is arranged at the upper container (3) close to the lower edge.

5. The seamless flowing type finishing machine according to claim 1, wherein the transmission mechanism (7) is a synchronous transmission mechanism.

6. The seamless flowing type finishing machine according to claim 1, wherein the number of the bolts (5) for connecting with the lower container and the upper container is six, and the bolts are annularly and uniformly distributed.

7. The seamless flowing type finishing machine according to claim 1, wherein inclined saw-tooth patterns are formed on the internal sidewall of the upper container (3).

8. The seamless flowing type finishing machine according to claim 1, wherein the water filling nozzle is connected with a storage container for storing mixture of water and grinding fluid; a metering pump used as a water intake power unit is arranged beside the storage container.

9. The seamless flowing type finishing machine according to claim 1, wherein the finishing machine is provided with a control device for controlling the rotating speed of the tray; the control device comprises an electric cabinet and a touch screen.

* * * * *